United States Patent [19]

Koshigoe et al.

[11] Patent Number: 4,728,858

[45] Date of Patent: Mar. 1, 1988

[54] COLOR CATHODE RAY TUBE APPARATUS

[75] Inventors: Shinpei Koshigoe, Fukaya; Takeshi Fujiwara, Kumagaya, both of Japan

[73] Assignee: Kabushiki Kaisha Toshiba, Kawasaki, Japan

[21] Appl. No.: 14,612

[22] Filed: Feb. 13, 1987

[30] Foreign Application Priority Data

Feb. 14, 1986 [JP] Japan ..... 51-28780

[51] Int. Cl.[4] ..... H01J 29/46; H01J 29/56

[52] U.S. Cl. ..... 315/15; 313/414; 313/449

[58] Field of Search ..... 315/382, 14, 15; 313/414, 449

[56] References Cited

U.S. PATENT DOCUMENTS 4,058,753 11/1977 Blacker et al. ..... 313/449

4,495,439 1/1985 Shimoma et al. ..... 313/414

FOREIGN PATENT DOCUMENTS 55-48423 12/1980 Japan .

*Primary Examiner*—Theodore M. Blum

*Attorney, Agent, or Firm*—Cushman, Darby & Cushman

[57] ABSTRACT

A color cathode ray tube apparatus having an electron gun assembly including a device for modulating a scanning velocity of electron beams at an auxiliary lens section for clarifying an image projected to a screen is disclosed. The color cathode ray tube apparatus comprises an enclosure having a panel section, a funnel section and a neck section, an electron gun assembly, including rear electrodes disposed in front of three cathodes for emitting electron beams, each having three through-holes for passing the beams for forming an auxiliary lens for preliminarily focusing the beams, and a front electrode located in front of the rear electrodes for forming a main lens in cooperation with one electrode thereof for further focusing the beams and converging the beams. The rear electrodes have a pair of electrode members having three beam through-holes defined by cylindrical projections, oblique surfaces opposed at a predetermined interval, formed of the cylindrical projections, each surface crossing perpendicularly to a horizontal plane for scanning the beams and having a predetermined angle with respect to a plane perpendicular to the axis of an electron beam path. The scanning velocity modulating device is connected with the pair of electrode members for supplying a modulating voltage thereto, when luminance values of a video signal arrive at a predetermined level.

8 Claims, 9 Drawing Figures

COLOR CATHODE RAY TUBE APPARATUS

BACKGROUND OF THE INVENTION

A. Field of the Invention

This invention relates to a color cathode ray tube apparatus and, more particularly, to a color cathode ray tube apparatus having an electron gun assembly provided with means for modulating a scanning velocity of electron beams for clarifying an image projected on a screen.

B. Description of the Prior Art

A system for modulating a scanning velocity of electron beams is known as one of the methods of producing a distinct image in a color cathode ray tube. The scanning velocity modulating systems are generally classified as electromagnetic deflecting systems and electrostatic deflecting systems. The basic principle of both systems varies the scanning velocity of electron beams on required image areas to clarify the image projected on a screen. A system for electrostatically deflecting electron beams in an electron gun assembly is disclosed as a method for modulating the scanning velocity of the electron beams in Japanese Patent Publication No. 48423/1980. A fourth grid as a focusing electrode in a unipotential type electron gun assembly disclosed in the official gazette is split, and a signal for modulating the scanning velocity in response to a luminance signal of a color video signal is supplied to the split electrodes.

Since a high voltage, such as 5 kV is applied to the focusing electrode in this system it is expensive to manufacture a circuit for modulating the high voltage. Also, since a potential difference between a high voltage electrode, or a third electrode, and an accelerating electrode, or a second electrode, is large, a problem arises in which a discharge is generated between the electrodes.

It is generally necessary to further raise the applied focusing voltage, or increase the length of a focusing electrode in an electron gun assembly to improve the focusing efficiency of the electron beam. However, if the focusing electrode is lengthened in the conventional electron gun, there are problems in that its deflecting sensitivity is deteriorated and the design of the circuit becomes difficult because of the higher modulating voltage. The voltage of the focusing electrode can be designed to be low, but, in this case, the magnification of its lens increases, and another problem occurs in which the diameter of the beam spot increases on a screen.

Since a unipotential type electron gun assembly is used in the conventional color cathode ray tube apparatus, the traveling velocity of the electron beams in the gun assembly is fast, and it is difficult to sufficiently accelerate the scanning velocity of the electron beams by scanning velocity modulating means. In addition, incident angles of three electron beams to a gap of the focusing electrode are not equal, and when electron beam scanning velocity modulating means is provided at the focusing electrode, the deflecting sensitivities of the beams are different, causing a misconvergence.

A color cathode ray tube apparatus in which means for modulating the scanning velocity of electron beams is provided at the focusing electrode of a unipotential type electron gun is difficult to manufacture for practical use, due to the above-mentioned problems.

SUMMARY OF THE INVENTION

An object of this invention is to provide a color cathode ray tube apparatus having an electron gun assembly which permits clarifying an image on a screen and enhancing the focusing and converging efficiency of electron beams without misconvergence.

According to the present invention, there is provided a color cathode ray tube apparatus comprising:

an enclosure including a panel section having a phosphor screen and a shadow mask, a funnel section mounted externally with a deflecting yoke and a neck section;

an electron gun assembly provided in the neck section of the enclosure, having three cathodes for emitting electron beams which are parallel with each other in a first plane, and a group of electrodes disposed in front of the cathodes with a predetermined interval between the adjacent electrodes, and having three electron beam paths for passing the electron beams, each electrode having three through-holes which compose the electron beam paths, the group of electrodes including:

rear electrodes for forming an auxiliary lens for preliminarily focusing the electron beams, one of the rear electrodes having a pair of electrode members applied with a relatively lower voltage, each member having cylindrical projections defining the through-holes, the cylindrical projections on one of the electrode members facing their counterparts on the other electrode member with a predetermined interval therebetween and each having an oblique surface at its end, each oblique surface having a predetermined angle with respect to a second plane perpendicular to the axis of the electron beam path but standing at right angles with the first plane, whereby the oblique surfaces of the projections have substantially the same inclination with respect to the electron beam paths, and a front electrode located in front of the rear electrodes so as to form a main lens in cooperation with one of the rear electrodes that is adjacent to the front electrode, for further focusing the electron beams preliminarily focused by the rear electrodes and for converging the electron beams; and a device connected to the electrodes for supplying an operating voltage thereto, having means for supplying a modulating voltage for modulating a scanning velocity of the electron beams to the pair of electrode members, when luminance values of a video signal arrive at a predetermined level.

As described above, oblique surfaces having an equal angle with respect to the three electron beams are formed at the ends of three cylindrical projections provided at a pair of electrode members as means for modulating the scanning velocity of the electron beams in the color cathode ray tube apparatus of this invention. Therefore, the modulating sensitivities of the three electron beams are equal, and the scanning velocity of the three beams are all accurately modulated. Further, since the scanning velocity of the beams are modulated at an auxiliary lens section, a halo of side beams of the color cathode ray tube apparatus of this invention can be remarkably alleviated as compared with that of the conventional color cathode ray tube, so that the image projected on a screen is clarified.

DETAILED DESCRIPTION OF THE PREFERRED EMBODIMENTS

Embodiments of the present invention will be described with reference to the accompanying drawings.

Figure 1:
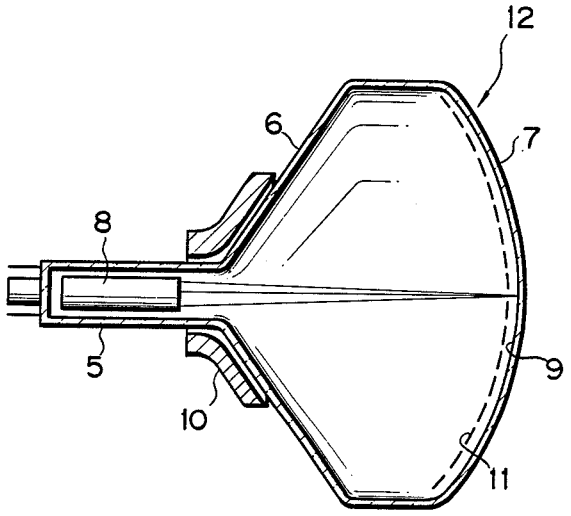
FIG. 1 is a horizontal sectional view schematically showing the construction of a color cathode ray tube.

In FIG. 1, the construction of a color cathode ray tube is schematically shown. The tube includes enclosure 12, having neck section 5, funnel section 6, panel section 7, and electron gun assembly 8, mounted in neck section 5, for generating three electron beams, focusing each beam and converging the beams. Shadow mask 11, having a color selecting function, is located at a predetermined interval inside panel section 7. Screen 9, having phosphor stripes or phosphor dots which emit lights by the beams emitted from gun assembly 8, is formed on the inner surface of panel section 7. Deflecting yoke 10, for scanning the beams at a constant velocity, is mounted on the outer surface of funnel section 6.

Figure 2:
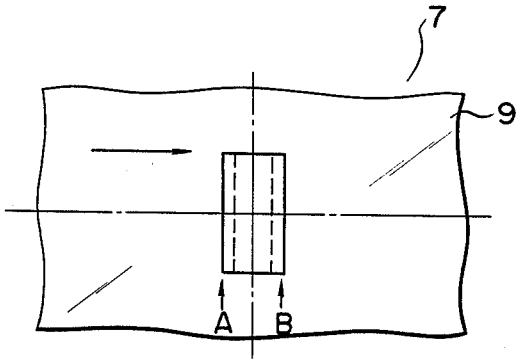
FIG. 2 is a diagrammatic view showing an image projected on a screen of the color cathode ray tube.

In the color cathode ray tube apparatus of the present invention, the scanning velocity of the beams is accelerated during scanning, in a portion where the luminance values of the screen are high, for clarifying the projected image on the screen of the color cathode ray tube. As shown, for example, in FIG. 2, when a high intensity luminous signal is inputted at point (A) on screen 9 in the apparatus, the scanning velocity is accelerated at point (A), and returned to the original velocity at point (B) after the velocity is modulated in a predetermined sequence. As a result, the projected image is finely clarified, as designated by broken lines in FIG. 2. In this apparatus, the means for modulating the scanning velocity of the beams is associated in the auxiliary lens section of the gun assembly, and the scanning velocity of the beams can be accelerated by deflecting the beams in the deflecting direction during scanning.

Figure 3:
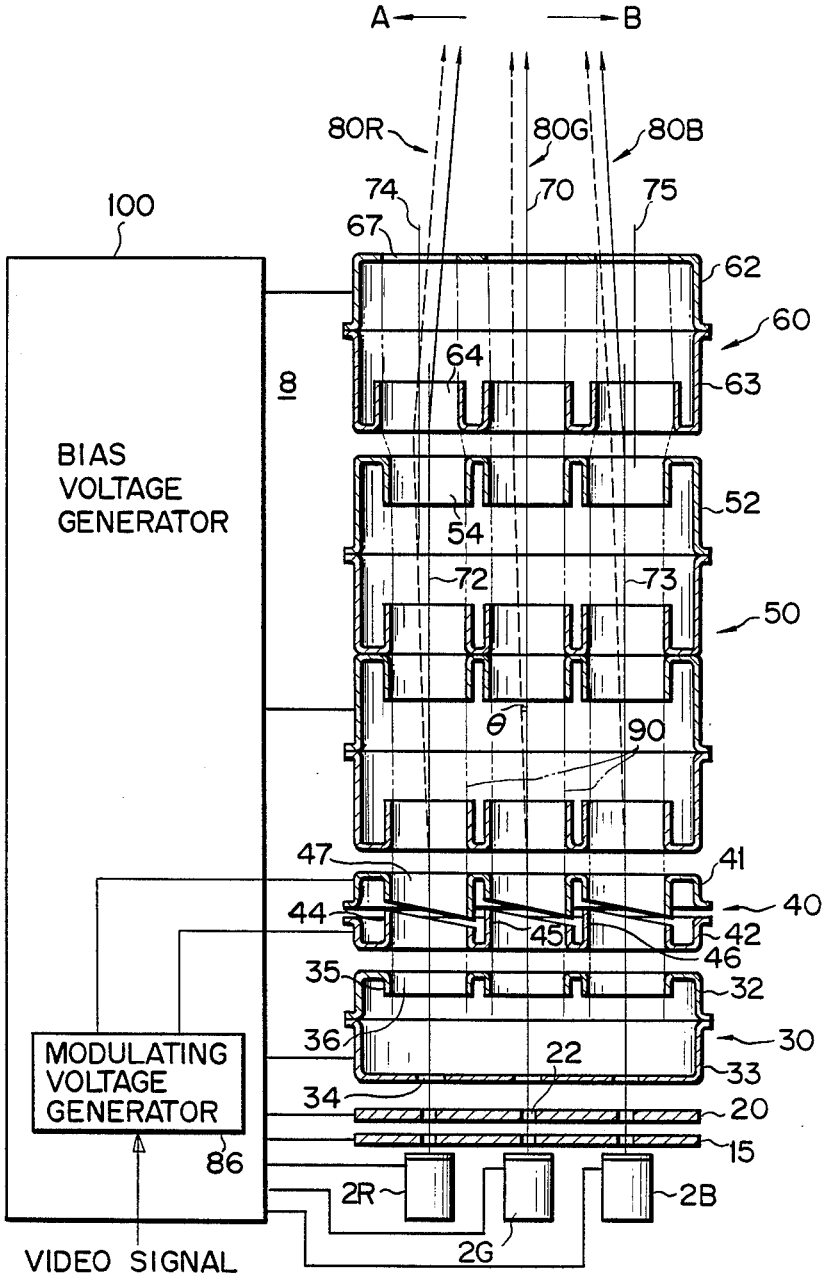
FIG. 3 is a partial sectional view schematically showing the construction of a color cathode ray tube apparatus according to an embodiment of the present invention.
Figure 4A:
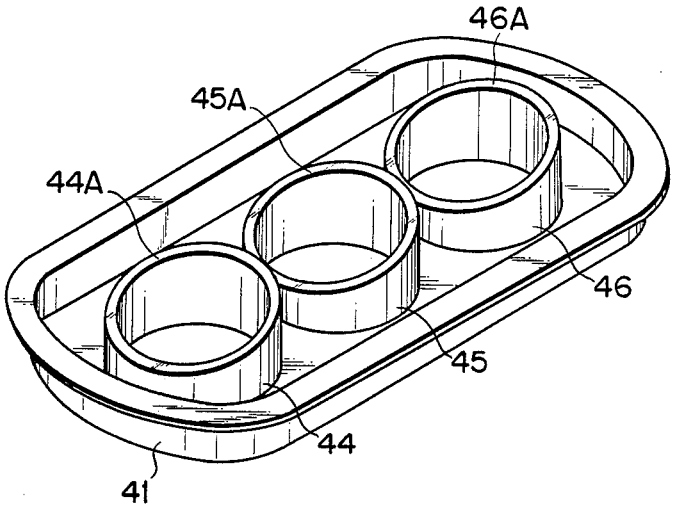
FIG. 4A is a perspective view showing one electrode member of the electron beam deflecting means.
Figure 8:
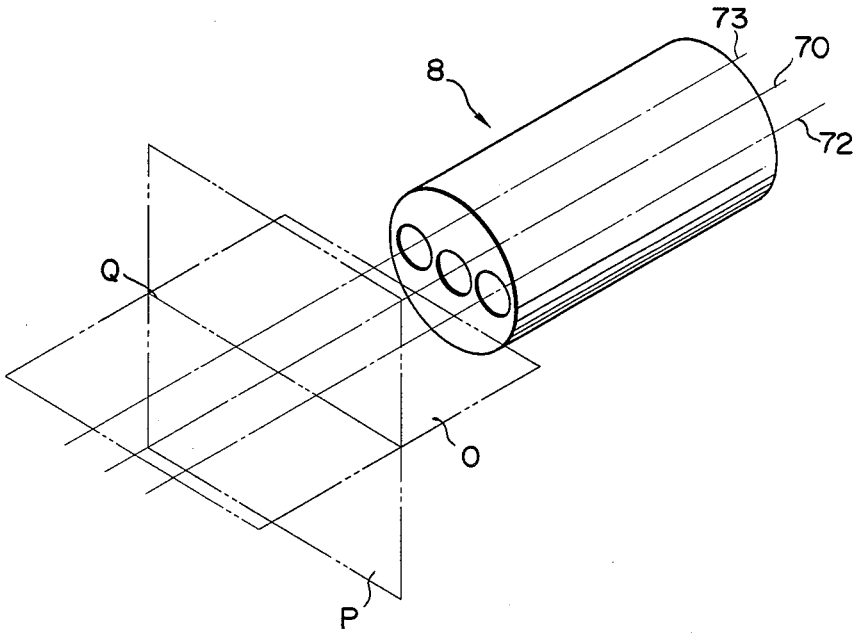
FIG. 8 is a perspective view schematically showing the electron gun assembly.

The electron gun assembly of the color cathode ray tube apparatus of the invention will be described. The gun assembly has three cathodes 2R, 2G, 2B, of an inline type, arranged in parallel in a horizontal plane (O) in FIG. 8, for emitting three electron beams to red, green and blue phosphor stripes, respectively, as shown in FIG. 3. First grid 15, second grid 20, third grid 30, fourth grid 40, fifth grid 50 and sixth grid 60 are sequentially located at predetermined intervals along the electron beam paths for focusing or converging the beams emitted from the respective cathodes. Each grid has three electron beam-passing openings for the three electron beams. Grid 15 is formed substantially in a plate-shaped electrode, through which three electron beam-passing openings are perforated for passing beams emitted from three cathodes 2R, 2G, 2B. Grid 20 is formed substantially in a plate-shaped electrode, and perforated with three electron beam-passing openings similar to grid 15. Grid 30 is formed by opposing the openings of two cup-shaped electrode members 32 and 33. A beam passing opening 34, having an inner diameter larger than that of opening 22 of grid 20, is perforated at the bottom portion of member 33 of grid 30, cylindrical projections 35, projected inwardly, are formed at the front part of member 32, and openings 36, each having an inner diameter larger than that of opening 34, are defined by projections. Grid 40, used as means for modulating the scanning velocity of the beams, has electrode members 41 and 42, each having three cylindrical projections 44, 45 and 46 defining beam-passing openings 47, and the projections 44, 45 and 46 of members 41 and 42 are opposed to each other. As shown in FIGS. 3 and 4A, the ends of the projections 44, 45 and 46 are cut obliquely at the same angle, each having a predetermined angle with respect to a plane (P) in FIG. 8 perpendicular to the axis of the electron beam paths to form oblique surfaces 44A, 45A and 46A, crossing perpendicularly to the horizontal plane (O) in which the beams are emitted. An interval between first member 41 and second member 42 is adjusted substantially to 0.2 to 0.3 mm. Grid 50 is formed by bonding a plurality of cup-shaped electrode members 52, each having electron beam-passing openings 54 defined by cylindrical projections including the same inner diameters as those of grid 40. Grid 60 is formed by opposing two cup-shaped electrode members 62 and 63. Member 63 has beam passing openings 64 defined by cylindrical projections including the same inner diameters as those of grid 50, and member 62 has beam passing openings 67 including no projections.

The openings disposed at the center of the openings for passing the center beam formed at the respective electrode members of grids 10 to 60 are all disposed coaxially to form a central beam path 90, shown by a broken line in FIG. 3. Axis 70 of the central beam path coincides with the center lines of the members, and substantially coincides with the axis of gun 8. The right and left side openings, for passing the side beams formed at the respective members of grids 10 to 50, are disposed on rectilinear lines without grid 60 to form right and left side beam paths. The right and left side beam paths have axes 72 and 73 parallel to axis 70 of the central beam paths through a predetermined interval, respectively. Cathodes 2R, 2G and 2B are disposed on axes 74, 70 and 75, respectively.

The right and left side beam passing openings of grid 60 are formed at positions different from the openings of other grids, and axes 74 and 75 of the openings are displaced in a direction separating from the central beam path with respect to axes 72 and 73 of the right and left side beam path of other grids.

Gun assembly 8, thus constructed, has modulating voltage generator 86 for supplying a modulating voltage for modulating the scanning velocity of the beams to grid 40 when the level of the luminance intensity value contained in a video signal exceeds a predetermined value.

The following voltages are, for example, applied to the respective electrodes by bias voltage generator 100. Approx. 150 V and a video signal is applied to cathodes 2R, 2G and 2B, a ground potential is applied to grid 15, approx. 600 V is applied to grid 20, and 7 to 8 kV is applied to grid 30. 600 V is normally applied to the electrode members of grid 40. When a scanning velocity modulating voltage is supplied, 800 V is applied, for example, to first member 41, and 400 V is applied to second member 42, to deflect the beams passing through the openings of grid 40 in a predetermined direction. Grid 50 is applied with the same voltage as grid 30, and a high voltage of approx. 25 kV is applied to grid 60.

When predetermined voltages are applied to the respective electrodes, cathodes 2R, 2G and 2B, grids 15 and 20 operate as triode of an electron beam-emitting source, a prefocusing lens is formed between grids 20 and 30, an auxiliary lens is formed in the areas of grids 30, 40 and 50, and a main lens is formed between grids 50 and 60. Therefore, electron beams emitted from the cathodes are preliminarily focused through the prefocusing lens and the auxiliary lens, and finally focused and converged through the main lens to form an electron beam spot on a screen.

The operational principle of the color cathode ray tube according to the invention will be described.

When approx. 600 V is applied to electrodes 41 and 42 of grid 40, central beam 80G is rectilinearly propagated from cathode 2G to the final electrode and emitted to the screen. Side beams 80R and 80B are rectilinearly propagated from cathodes 2R and 2B, deflected in a central beam direction during passing between grids 50 and 60, and crossed at a point with the central beam near the shadow mask.

When different voltages are applied to electrodes 41 and 42 of grid 40, three electron beams are all deflected in a predetermined direction when passing the openings of grid 40. If a voltage higher than member 42 is, for example, applied to member 41, the beams are all deflected in a direction of an arrow B in FIG. 3. If a voltage higher than member 41 is, on the contrary, applied to member 42, the beams are all deflected in the direction of arrow A in FIG. 3. The deflecting directions and angles of the central and side beams are maintained equal, since the angles of the oblique surfaces of the ends of the cylindrical projections of members 41 and 42 are all equal.

The deflecting angles ($\theta$) of the beams in FIG. 3 are set to predetermined values in response to the size of the cathode ray tube. For example, in the case of a 26 type 110 degrees deflecting angle cathode ray tube, its deflecting angle is set to approx. 0.17 degree$\times$2=0.34 degree. The electron beam spot on the screen moves approx. 2 mm on the screen by this deflecting angle.

Figure 5:
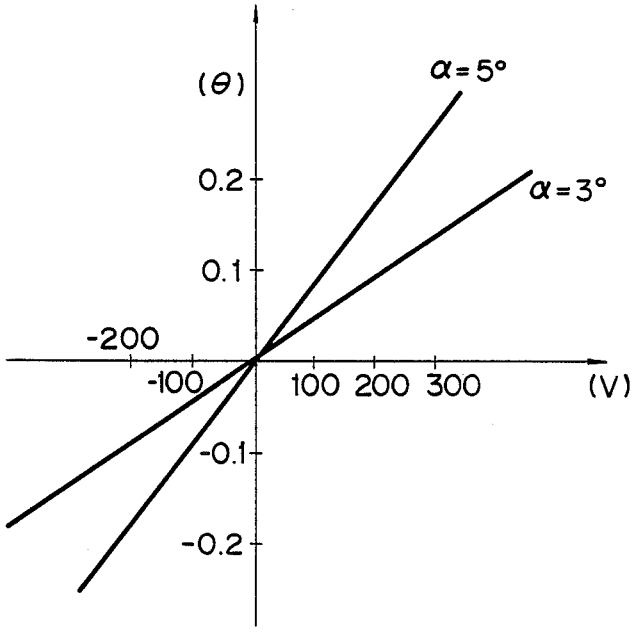
FIG. 5 is a graph showing the relationship between a modulating voltage (V) applied to the electron beam deflecting means and the deflecting angle ($\theta$) of the electron beam in the case where the oblique angles ($\alpha$) of the end of the projection of the electrode member are 3 and 5 degrees.

The deflecting angle ($\theta$) of the electron beam is set by the inclining angles ($\alpha$) of the ends of the cylindrical projections of members 41, 42 and modulating voltage (V). FIG. 5 shows a graph illustrating the relationship between the deflecting angle ($\theta$) and the modulating voltage (V) in the case where the inclining angles ($\alpha$) are 5 and 3 degrees. As seen in the graph, the deflecting angle ($\theta$) increases proportionally to the modulating voltage (V) and the inclining angle ($\alpha$).

An embodiment of an electron gun assembly of a color cathode ray tube apparatus according to the invention will be described in more detail.

In this embodiment, the inner diameters of the electron beam-passing openings formed at first electrode members 32 of third grid 30 to first electrode member 62 of sixth grid 60 are 5.5 mm. The intervals between the axis of the central beam path and the axes of the right and left side beam paths are 6.6 mm from first grid 10 to fifth grid 50, and 6.8 mm to sixth grid 60.

Figure 4B:
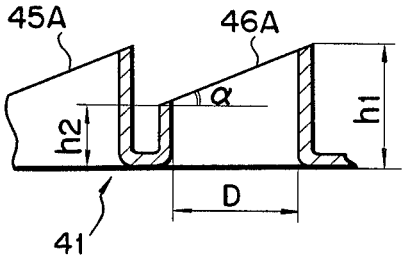
FIG. 4B is a side sectional view showing a part of the electrode member of FIG. 4A.

Heights h1 and h2 and the inclining angle ($\alpha$) of the oblique surfaces of the cylindrical projections of members 41, 42 in FIG. 4B are shown below.

h1=1.0 mm h2=0.6 mm $$\alpha = \tan^{-1}\frac{1.0 - 0.6}{5.5} = 4.2^\circ$$

In this embodiment, electrode members 41 and 42 are formed in the same sizes in the respective portions. However, the portions may not always be formed in the same sizes.

Figure 6:
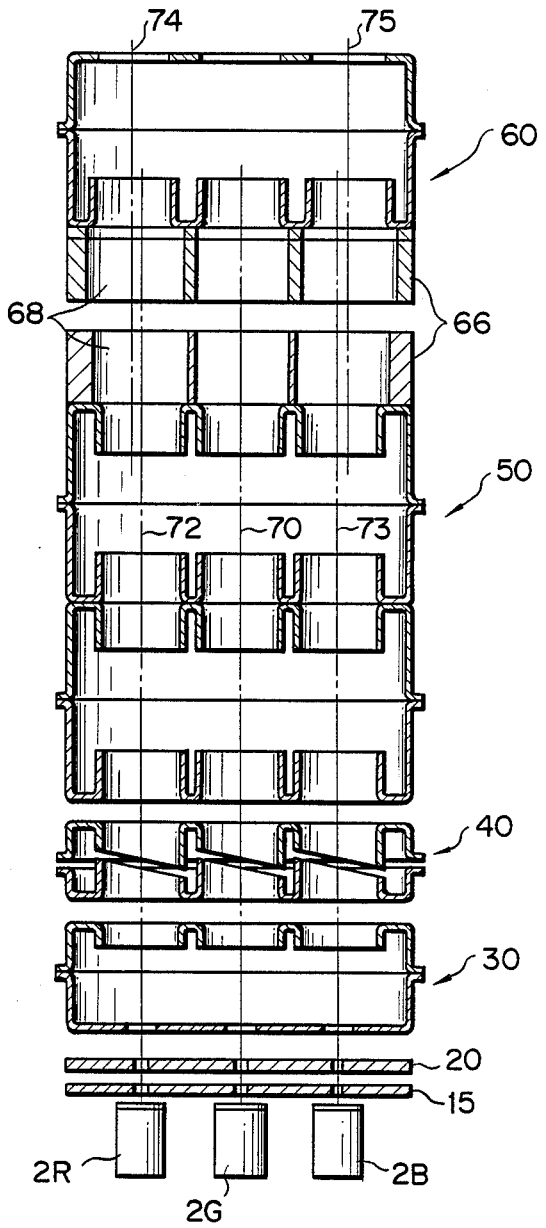
FIG. 6 is a horizontal sectional view showing a modification of a main lens provided in the electron gun assembly of a color cathode ray tube apparatus of the invention.

FIG. 6 shows a modification of a main lens in an electron gun assembly of a color cathode ray tube apparatus of the invention. In the modification, a thick electrode member 66, having electron beam passing openings 68 of a large diameter, is mounted on each opposed surface of fifth and sixth grids 50 and 60. Therefore, in this gun, the openings are increased by approx. 13% as compared with openings of the gun in FIG. 1, whereby the focusing efficiency of the beams can be further improved.

Figure 7:
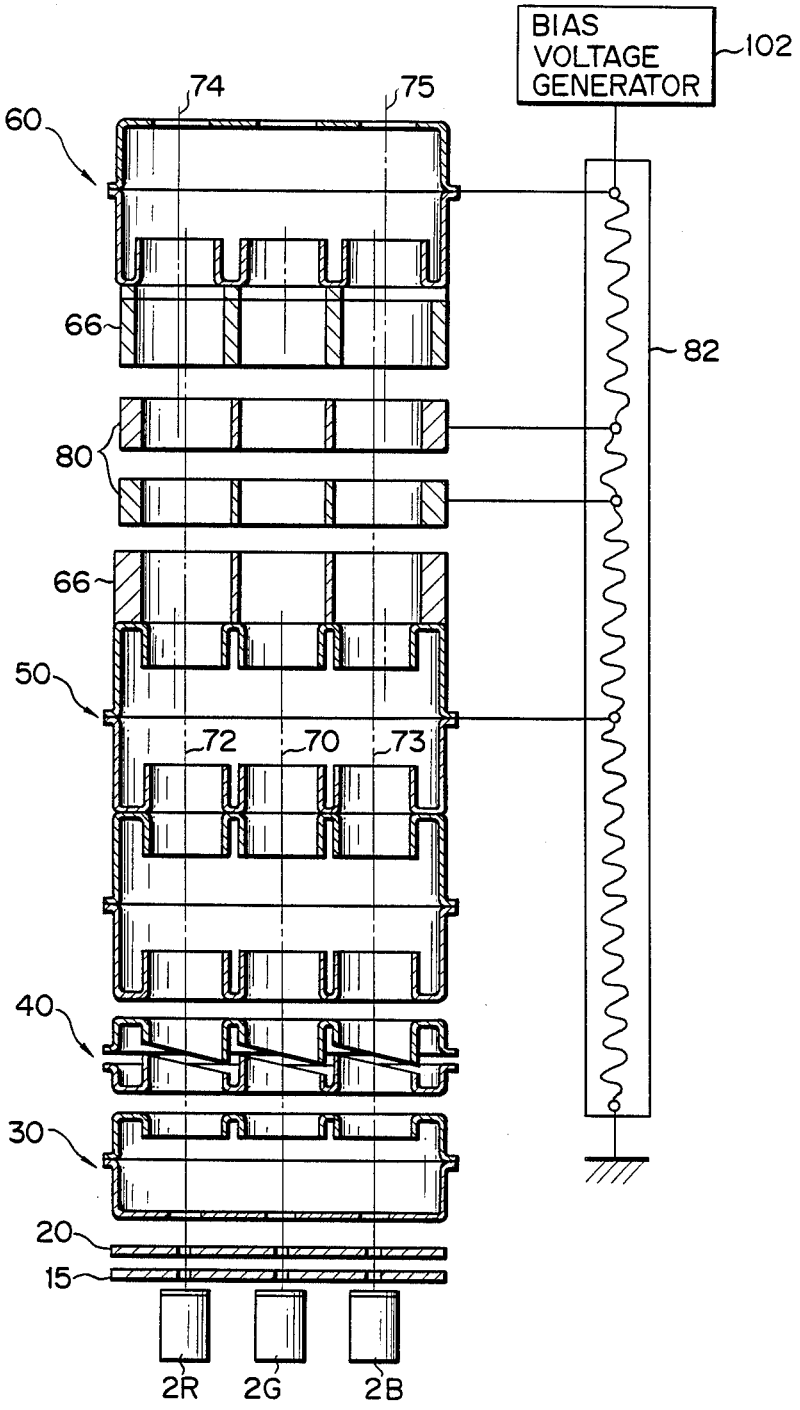
FIG. 7 is a horizontal sectional view showing the other modification of the main lens.

FIG. 7 shows a second modification of a main lens in an electron gun assembly according to the invention. In the second modification, an interval between fifth and sixth grids 50 and 60 is extended, and a plurality of auxiliary electrodes 80 are disposed therebetween. Electrodes 80 and other electrodes are connected through resistor 82 with sixth grid 60, and a predetermined voltage divided by resistor 82 is applied to electrodes 80 by bias voltage generator 102. Therefore, in the gun assembly, the focusing efficiency of the main lens can be further improved by approx. 20%, and a halo of the side beams can be further alleviated, when compared with that of the gun assembly of the above-mentioned embodiments.

In the color cathode ray tube apparatus of the invention as described above, the oblique surfaces having the same angle with respect to the three electron beams are formed at the ends of the cylindrical projections formed at fourth grid 40, as means for modulating the scanning velocity of the beams. Therefore, the modulating sensitivities of the three beams are equal, so as to accurately modulate all three scanning velocity of the beams. As a result, a halo of the side beams can be remarkably alleviated without convergence error, and thus clarify the image. Further, in the electron gun assembly of the color cathode ray tube apparatus according to the invention, the scanning velocity modulation of the beams is performed in the auxiliary lens section. Therefore, the diameters of the beams are small in the auxiliary lens area, and the beams are not significantly distorted by the deflection. As a result, the beam spot on the screen is less deflected, when compared with that of the conventional cathode ray tube, to enhance the visibility of the image. Further, since the velocity of the beams is relatively slow in the auxiliary lens section, the modulating sensitivity of the gun assembly is improved. Moreover, since a relatively lower voltage is applied to the electrodes as the scanning velocity modulating means, even if the electrodes are split, a discharge between the split electrodes can be prevented.

What is claimed is:

1. A color cathode ray tube apparatus comprising:

an enclosure including a panel section having a phosphor screen and a shadow mask, a funnel section mounted externally with a deflecting yoke and a neck section;

an electron gun assembly provided in the neck section of the enclosure, having three cathodes for emitting electron beams which are parallel to each other in a first plane, and a group of electrodes located in front of the cathodes with a predetermined interval between the adjacent electrodes, and having three electron beam paths for passing the electron beams, each electrode having three through-holes which compose the electron beam paths, the group of electrodes including rear electrodes for forming an auxiliary lens for preliminarily focusing the electron beams, one of the rear electrodes having a pair of electrode members applied with a relatively lower voltage, each member having cylindrical projections defining the through-holes, the cylindrical projections on one of the electrode members facing their counterparts on the other electrode member with a predetermined interval therebetween and each having an oblique surface at its end, each oblique surface having a predetermined angle with respect to a second plane perpendicular to the axis of the electron beam path but standing at right angles with the first plane, whereby the oblique surfaces of the projections have substantially the same inclination with respect to the electron beam paths, and a front electrode located in front of the rear electrodes to form a main lens, in cooperation with one of the rear electrodes that is adjacent to the front electrode for further focusing the electron beams preliminarily focused by the rear electrodes and for converging the electron beams; and a device connected to the electrodes for supplying an operating voltage thereto, having means for supplying a modulating voltage for modulating a scanning velocity of the electron beams to the pair of electrode members, when luminance values of a video signal arrive at a predetermined level.

2. A color cathode ray tube apparatus according to claim 1, wherein the oblique surfaces of the cylindrical projections on one of the electron members are substantially in parallel with their counterparts on the other electron member.

3. A color cathode ray tube apparatus according to claim 1, wherein a line of intersection of said first plane and said second plane is parallel with a horizontal scanning direction of said electron beams.

4. A color cathode ray tube apparatus according to claim 1, wherein said rear electrodes for forming an auxiliary lens are a unipotential type and said front electrode for forming a main lens in cooperation with a front electrode of said rear electrodes is a bipotential type.

5. A color cathode ray tube apparatus according to claim 1, wherein said group of electrodes have a plate-shaped first grid, a plate-shaped second grid, a third grid formed by opposing the openings of two cup-shaped electrode members, sequentially arranged at predetermined intervals, a fourth grid having said electrode members, and fifth and sixth grids, formed by bonding a plurality of cup-shaped electrode members.

6. A color cathode ray tube apparatus according to claim 5, further comprising: two thick electrode members mounted between said fifth and sixth grids and each perforated with three through-holes having large diameters, one of said thick electrode members mounted on the front surface of said fifth grid, the other thereof mounted on the rear surface of said sixth grid in such a manner that a predetermined interval is provided between said thick electrode members.

7. A color cathode ray tube apparatus according to claim 6, further comprising: a plurality of auxiliary electrodes inserted between said two thick electrodes, said auxiliary electrodes connected through a resistor to said sixth grid, and applied with a predetermined divided voltage.

8. A color cathode ray tube apparatus according to claim 5, wherein approx. 150 V is applied to said cathodes, a ground potential is applied to said first grid, approx. 600 V is applied to said second grid, 7 to 8 kV is applied to said third grid, 400 to 800 V is applied to the pair of electrode members of said fourth grid, the same voltage as said third grid is applied to said fifth grid, and approx. 25 kV is applied to said sixth grid.

* * * * *

UNITED STATES PATENT AND TRADEMARK OFFICE

CERTIFICATE OF CORRECTION

PATENT NO. : 4,728,858

DATED : Mar 1, 1988

INVENTOR(S) : Shinpei KOSHIGOE, Takeshi FUJIWARA

It is certified that error appears in the above-identified patent and that said Letters Patent is hereby corrected as shown below:

ON THE TITLE PAGE:

Please change

"Foreign Application Priority Data 51-28780" to

--61-28780--.

Signed and Sealed this

Tenth Day of January, 1989

*Attest:*

*Attesting Officer*

DONALD J. QUIGG

*Commissioner of Patents and Trademarks*